United States Patent [19]

Carollo

[11] 4,346,342

[45] Aug. 24, 1982

[54] CURRENT LIMITING VOLTAGE REGULATOR

[75] Inventor: James A. Carollo, Cedar Rapids, Iowa

[73] Assignee: Rockwell International Corporation, El Segundo, Calif.

[21] Appl. No.: 271,768

[22] Filed: Jun. 9, 1981

[51] Int. Cl.[3] ..... G05F 1/44

[52] U.S. Cl. ..... 323/276

[58] Field of Search ..... 323/273, 275, 276, 277, 323/281; 363/89

[56] References Cited

U.S. PATENT DOCUMENTS

| | | | |
|---|---|---|---|
| 3,305,725 | 2/1967 | Huge et al. | 323/277 X |
| 3,327,201 | 6/1967 | Brantley, Jr. | 323/277 |
| 3,678,370 | 7/1972 | Gately | 323/277 |

*Primary Examiner*—William M. Shoop
*Attorney, Agent, or Firm*—Richard K. Robinson; Howard R. Greenberg; H. Fredrick Hamann

[57] ABSTRACT

A voltage regulator for a DC power supply senses the current in the return line of the power supply and compares the sensed current to a threshold that is generated within the regulator section of the power supply. When the sensed current exceeds the threshold, a detector circuit will sense the threshold being exceeded and override the voltage control circuit that is used to regulate the DC power supply and reduce or remove the output voltage until the sensed current falls below the threshold level. The current limiting action is preformed by controlling the conductance of the pass element so that the pass element is always operating within its safe operating area.

7 Claims, 3 Drawing Figures

CURRENT LIMITING VOLTAGE REGULATOR

BACKGROUND OF THE INVENTION

This invention relates to voltage regulators for DC power supplies and in particular, to current limiting voltage regulators for DC power supplies.

Direct current (DC) power supplies that provide the combination of high voltages and high currents require that the series pass elements in the regulators be prevented from going into secondary break-down. The prior art utilized the technique of current fold-back during current limiting to prevent secondary breakdown. Current fold-back refers to graphical representation of the voltage and current response of the output voltage of a DC power supply when plotted and shows the current folding back under the rated output power when the voltage values are plotted along an abscissa and the current is plotted along an ordinate. The prior art current fold-back circuits often allowed the product of the voltage and current in time to exceed the Safe Operating Area (SOA) of the series pass element. The SOA of transistor pass elements is provided by the manufacturer and is a curve that represents the voltage and current combinations, which will cause secondary breakdown of the transistor.

There are several methods of regulation with current limiting capabilities known in the art. One method is referred to as the "crowbar" method, and uses a comparator to detect when a power supply reaches a current limit and on that occurrence removes power from the power supply, and thus protects the power supply from being over-loaded and causing damage to the pass element used in the regulator.

Precision power supplies often include a preregulated supply that drives a series regulator. The preregulation is implemented by use of SCR pulse modulation techniques that modulate the AC input power to obtain an intermediate voltage which is higher than the desired voltage. The series regulator is then used as a filter to remove the difference between the intermediate voltage and the desired voltage. The series pass element in this embodiment is only regulating a few volts, which is ripple voltage, and consequently the series pass element is able to handle large currents during current limiting because there is only a small voltage drop across the transistor; consequently, the transistor is operating in its largest safe operating area. However, the preregulated followed by the series regulated combination type power supply requires two complex voltage control loops and consequently, the current limiting action is slow, due to the slow control action of the preregulated supply. The slowness of the two voltage control loops does not protect against a large instantaneous current, such as a shorted load, which requires that current limitation be applied quickly.

Other prior art circuits, to compensate for the SOA limitations, used several parallel combinations of the transistors as series pass element so that the combined SOA is large enough to survive the fold-back current limiting curves of these supplies. This technique involves additional expense for the duplication of the series pass element.

SUMMARY OF THE INVENTION

A voltage regulator for a DC power supply senses the current in the return line of the power supply and compares the sensed current to a threshold that is generated within the regulator section of tne power supply. When the sensed current exceeds the threshold, a detector circuit will sense the threshold being exceeded and override the voltage control circuit that is used to regulate the DC power supply and reduce or remove the output voltage until the sensed current falls below the threshold level. The current limiting action is performed by controlling the conductance of the pass element so that the pass element is always operating within its safe operating area.

There is provided a detailed discussion of the circuitry necessary to implement the current sensor, the generation of the threshold signal, the detecting of the difference between the threshold signal and the sensed current, as well as the voltage control for controlling the pass element used in the power supply and the apparatuses for overriding the voltage controls circuit.

It is the objective of the invention to provide a current limiting voltage regulator that will limit the current without removing the power from the power supply that the regulator is regulating.

It is another objective of the invention to provide a current limiting regulator for regulating a DC power supply that does not require the use of excess transistor pass elements to ensure that these devices operate within their specified SOA.

It is yet another objective of the invention to provide a current limiting voltage regulator for a DC power supply whose voltage control loops are simple and consequently, the current limiting may be implemented very rapidly.

It is still another objective of the invention to provide a current limiting voltage regulator for a DC power supply that has high immunity to false triggering from switch loads that approach the current limiting points.

It is still another objective of the invention to provide a current limiting voltage regulator for a DC power supply that maximizes the safe operating area of the pass element during the current limiting action by ensuring that the voltage and current response of the pass element is within its safe operating area.

BRIEF DESCRIPTION OF THE DRAWINGS

Many advantages of the present invention may be ascertained from a reading of the specification and the claims in conjunction with the Figures in which:

DETAILED DESCRIPTION OF THE PREFERRED EMBODIMENT

Figure 1:
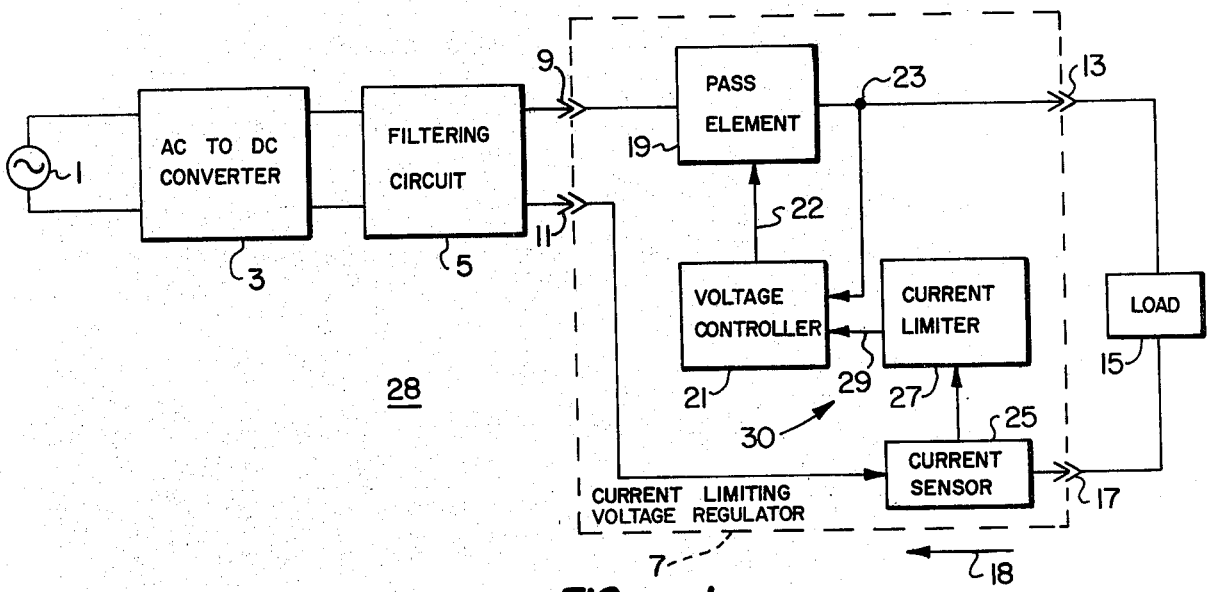
FIG. 1 is a simplified block diagram of a DC power supply with a current limiting regulator according to the invention.

FIG. 1, to which reference should now be made, there is shown a DC power supply 28 with a current limiting voltage regulator 7. An AC source 1, drives an AC to DC converter 3, which in the preferred embodiment includes a coupling transformer and a bridge rectifier. The coupling transformer couples the AC voltage from the AC source 1 to a bridge rectifier where the AC voltage is converted to an unregulated and unfiltered DC voltage. The unregulated and unfiltered DC voltage is applied to a filtering circuit 5 for filtering. After filtering, there is present across terminals 9 and 11, an unregulated DC voltage. The current limiting voltage regulator 7 regulates the unregulated voltage that is present across terminals 9 and 11, and provides regulated DC voltage to a load 15 via a output terminal 13 and a return terminal 17.

The current limiting voltage regulator 7 maintains a constant voltage level between the output terminal 13 and the return terminal 17 through the action of a voltage controller 21. The voltage controller 21 monitors the voltage at point 23, and based upon the monitored voltage, will adjust a pass element 19 to either raise or lower the voltage at output terminal 13. The pass element 19, in the preferred embodiment, is a transistor or bank of transistors whose conductance is varied by the magnitude of the signal on conductor 22, and consequently, the voltage drop between terminal 9 and output terminal 13 is varied, ensuring thereby, the regulation of the voltage between the output terminal 13 and the return terminal 17. Protection of the pass element 19, as well as the remainder of the power supply circuits is provided by a current limiting circuit 30, that includes a current sensor 25 that senses the return current flow as indicated by arrow 18 and a current limiter 27 that responds to the sensed current. The current limiter 27, when there is an excessive current flow indicated by the current sensor 25, provides a signal on conductor 29 that causes the voltage controller 21 to override the sensed voltage at point 23 and decrease the conductance of the pass element 19. This action prevents the pass element 19 from operating out of its safe operating area protecting not only the pass element 19 but the remainder of the DC power supply 28.

Figure 2:
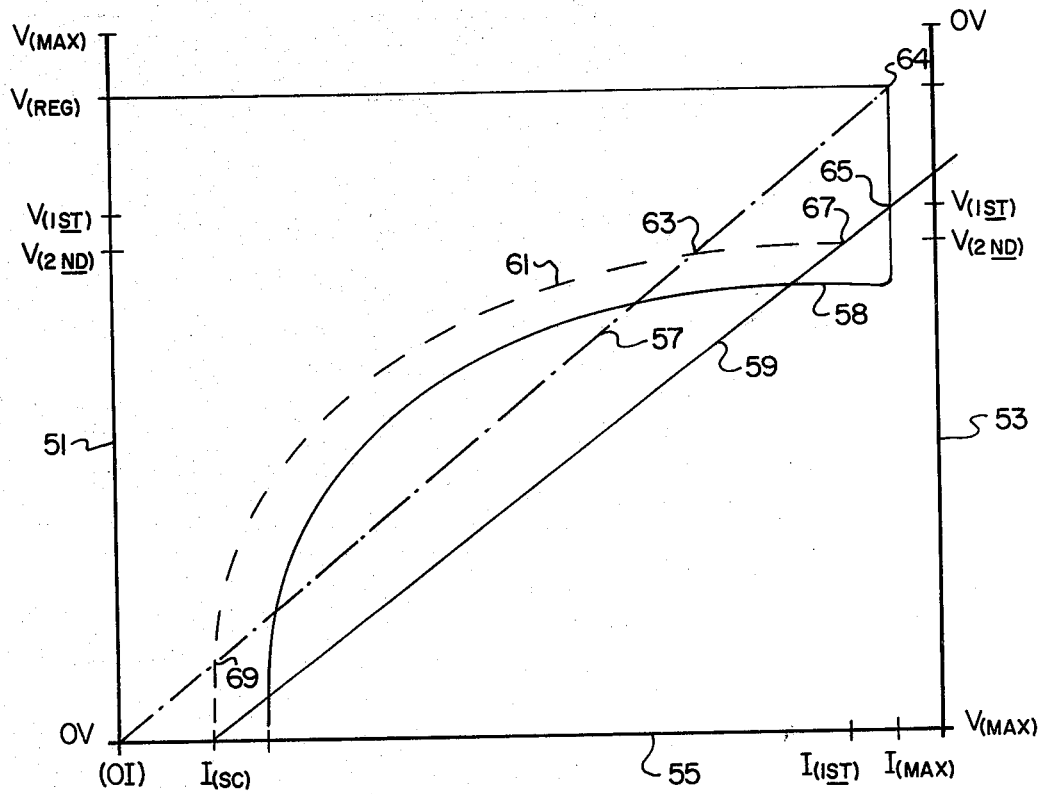
FIG. 2 is a power response curve of the pass element that is used in the regulator according to the invention.

FIG. 2, to which reference should now be made, is a graph of the voltage and current response of the pass element 19, and is applicable to any transistor type pass element. A first abscissa is represented by line 51 and is a plot of the output voltage that is present across the output terminal 13 and the return terminal 17. A second abscissa is represented by the line 53 and is a plot of the voltage that is dropped across the pass element 19, or essentially between the terminal 9 and the output terminal 13. The ordinate 55 is a plot of the current that flows through the return terminal 17 as indicated by the arrow 18 of FIG. 1. V(max) is the unregulated output voltage that is present across terminals 9 and 11. The regulated voltage is represented by V(reg) and is the output voltage that is present between the output terminal 13 and the return terminal 19. Load line 57 is a line that connects zero voltage (0V) and a zero current (0I) to point 64, which is the maximum current I(max), at the regulated voltage. The voltage and current represented by point 64 is not exceeded due to the current limiting action of the current limiter 27 that forces the voltage controller 21 to decrease the conductance of the pass element 19, causing the output voltage between the output terminal 13 and the return terminal 17 to decrease to the V(1st) point as indicated at point 65. The second stage is the V(2nd) point indicated at the point 67 and occurs very quickly after the first stage and indicates, if current limiting is still required, further overriding of the voltage controller 21 by the current limiter 27. In order to ensure that the pass element 19 operates within its safe operating area, it is necessary for the coordinates of the voltage and current that is represented on the graph of FIG. 2 to fall within the area to the left of curve 58. The third stage falls in the area to the left of the curve 58, and also behind the load line 57 and is a state in which at point 63 the operation of the voltage controller 21 forces the response of the pass element 19 to follow the curve 61 during current limiting, or at short circuit conditions. Short circuit conditions are represented by I(SC) and illustrates the current that flows during the period of time that the load 15 is a short circuit. Point 69 is where curve 61 crosses the load line 57 and this current enables the DC power supply to apply an output voltage to the load on initial startup. Line 59 is the line most prior art current limiting regulators followed, and thus operates out of the safe operating area of a given pass element which is the area to the left of the load line 57 and curve 58.

Figure 3:
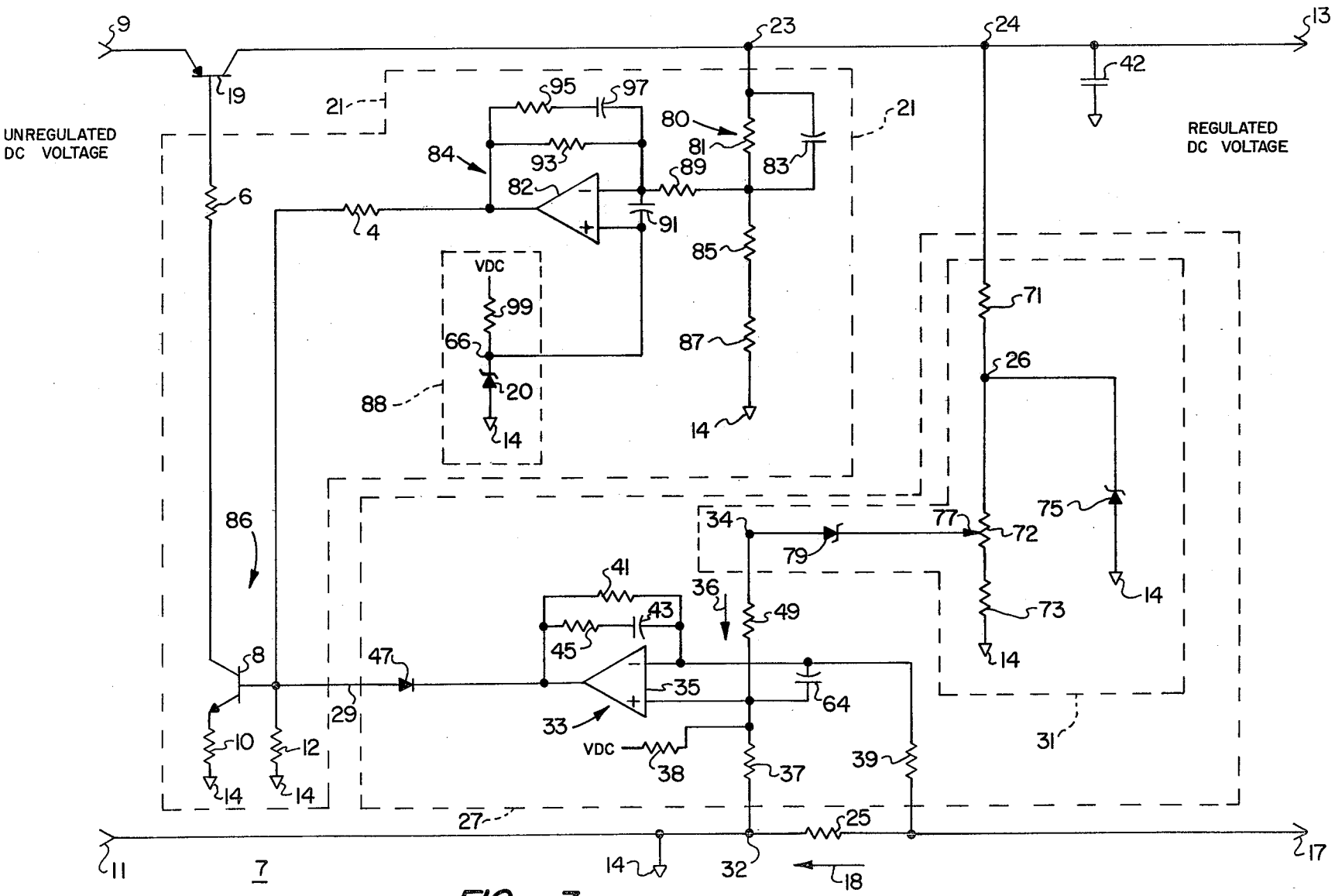
FIG. 3 is a schematic diagram of the current limiting regulator according to the invention.

FIG. 3 is a schematic diagram of the current limiting regulator 7 of FIG. 1, and includes a transistor pass element 19, whose conductance is varied to regulate the unregulated DC voltage that is applied between terminals 9 and 11 to obtain the regulated DC voltage between the output terminal 13 and the return terminal 17. The voltage is monitored at point 23 by the voltage controller 21 which includes a comparator circuit 84, that compares the voltage at point 23, after being divided by a voltage divider circuit 80, with a voltage reference provided by a voltage reference source 88 to obtain a difference from the comparison that is used to bias a transistor drive circuit 86 that controls the conductance of the transistor pass element 19. The voltage divider circuit 80 consists of the resistors 81, 85 and 87 that are connected between point 23 and chassis ground 14. The reference source 88 includes a resistor 99 and a zener diode 20, which are in a series connection between a voltage source VDC (not shown) and chassis ground 14. Resistor 99 in the preferred embodiment is a combination of selected resistors and potentiometers that are used to establish the proper threshold for the voltage to the comparator circuit 84 at point 66. Resistor 85 is a selected resistor in the preferred embodiment and in conjunction with resistor 99 is used to establish the proper output voltage under laboratory or test selected conditions. The comparator circuit 84 includes an operational amplifier 82, whose gain is established by the resistors 89 and 93, and the frequency response of the amplifier is established by the combination of resistor 95 and capacitors 97 and 83. Capacitor 91 provides additional filtering across the input terminals of the operational amplifier 82. The output of the operational amplifier 82 is applied to the transistor drive circuit 86 via resistor 4. The transistor drive circuit 86 includes a transistor 8 and a resistor 10. Biasing of the transistor 8 is provided by the resistor 12 being connected from the base of transistor 8 to chassis ground 14. The gain of the transistor 8 is established by the emitter resistor 10. Resistor 6 connects the collector of the transistor 8 to the base of the transistor pass element 19. Normal operation of the output of the comparator circuit 84 adjusts the voltage level on the base of the transistor 8, causing the transistor 8 to either increase or decrease the conductance of the transistor pass element 19 by varying the current flow through the resistor 6, and through the collector and emitter of the transistor 8, to chassis ground 14 via resistor 10.

The output of the voltage comparator 84 may be overridden by the current limiter 27 that includes a reference threshold circuit 31, a detector circuit 33 that detects when the current as represented by the arrow 18 exceeds the threshold as provided by the reference threshold circuit 31, and a blocking diode 47, that prevents the output of the detector circuit 33 from influencing the voltage controller 21, unless the current flow that is represented by arrow 18 exceeds the threshold that is provided by the reference threshold circuit 31. Resistor 25 is the current sensor and senses the return current that flows from the return terminal 17 to the terminal 11, as represented by arrow 18. The reference threshold circuit 31 provides a dynamic current threshold reference signal to the detector circuit 33 and includes, in the preferred embodiment, a resistor divider network that includes a resistor 71, a variable resistor 72, and a resistor 73 connected between point 24, which has the same regulated DC voltage present that is present at the output terminal 13 and chassis ground. A zener diode 75 is connected across the variable resistor 72 and resistor 73, and establishes under noncurrent limiting conditions a reference potential at point 26 that is divided down by the variable resistor 72 and a resistor 73. Zener diode 79 and resistor 49 operate in conjunction with resistor 37 so that under noncurrent limiting conditions the voltage that is developed by the current flow through resistors 49 and 37, as indicated by arrow 36, and is present at the positive terminal of the operational amplifier 35 is greater than or equal to the voltage that is present at the negative terminal of operational amplifier 35, which results from the current flow through resistor 25 and coupled to the negative terminal of the operational amplifier 35 by resistor 39.

The operation of the current limiting voltage regulator may be more fully understood when FIG. 2 is used in conjunction with the remaining discussion of FIG. 3. When the voltage that is present on the negative terminal of operational amplifier 35 is greater than the voltage that is present on the positive terminal of the operational amplifier 35, then the current limiting voltage regulator 7 initiates current limiting when diode 47 is forward biased and conducts causing transistor 8 to lose conduction and therefore causing the transistor pass element 19 to lose conduction; thus, lowering the output voltage at point 24. This is represented on FIG. 2 by the region between points 64 and 65. The voltage at point 24 will continue to drop under the current limiting action until the voltage at point 26 falls below the zener voltage of the zener diode 75. Point 26 then reflects the output voltage divided by the divider network of resistor 71, variable resistor 72 and resistor 73. If the voltage on the positive terminal of operational amplifier 35 continues to fall, as it will go under extreme current limiting conditions or short circuit conditions, then the voltage on wiper arm 77 will fall reducing the current indicated by arrow 36. The lowering of the current through resistor 49, lowers the voltage on the positive terminal of operational amplifier 35, which will further reduce the allowed current to the load 15. This current limiting action is represented by the line between points 65 and 67 on FIG. 2.

When the output voltage reaches V(2nd) and the load current reaches I(1st) represented by point 67, the zener diode 79 will begin to lose conduction due to the small amount of current which is now flowing through it. This loss of conduction in zener diode 79 will cause further reduction of voltage at the positive terminal of operational amplifier 35. The further reduction of the voltage at the positive terminal of operational amplifier 35, further reduces the output of current through load 15, which in turn drops the output voltage at point 24, which further reduces the voltage at wiper arm 77 which continues to reduce the conduction of zener diode 79 even further, until all current through the zener diode 79 ceases and the output voltage at point 24 is at zero volts and load current indicated by arrow 18 is reduced to the value I(SC). This fall of output voltage and load current is described by curve 61 of FIG. 2.

The I(SC) point is created by the current flow through resistor 37 from the voltage source VDC and resistor 38. I(SC) is required, as mentioned earlier, for the startup of the current limiting voltage regulator 7 into a load. The rate at which the current limiting voltage regulator 7 traverses between point 67 and I(SC) is limited by two factors. The first factors is the storage time ($+_s$) and fall time ($+_f$) of the transistors used for the pass elements, which determines the minimum time it would take to transverse between point 67 and I(SC). The second factor determining the speed of transition between point 67 and I(SC) is the time constant determined by the output load impedance and capacitor 42, which is the output capacitor of the current limiting voltage regulator 7. This factor will usually dominate over the first factor mentioned, but by keeping this capacitor small in value will ensure a very fast transition between point 67 and I(SC), which will maximize the safe operating area of the transistor pass element 19. The values of the components used in FIG. 3 are provided in Table 1.

TABLE 1

| Figure Reference Number | Value or Part Number | |
|---|---|---|
| 4 | 2.2KΩ | |
| 6 | 383Ω | |
| 8 | 2N3441 | |
| 10 | 15Ω | |
| 12 | 10KΩ | |
| 19 | 2N6052 | |
| 25 | 0.014Ω | |
| 35 | LM124 | |
| 37 | 1KΩ | |
| 39 | 1KΩ | |
| 41 | 1MΩ | |
| 42 | 47 μF | |
| 43 | 0.01 μF | |
| 45 | 100Ω | |
| 47 | 1N4454 | |
| 49 | 10KΩ | |
| 64 | 100PF | |
| 71 | 33.2KΩ | |
| 72 | 5KΩ | |
| 73 | 6.19KΩ | |
| 75 | 1N755A | |
| 79 | 1N4620 | |
| 81 | 33.2KΩ | |
| 82 | LM124 | |
| 83 | 0.01 μF | |
| 85 | ≈1KΩ | adjustable |
| 87 | 4.42kΩ | |
| 89 | 1KΩ | |
| 91 | 100PF | |
| 93 | 100KΩ | |
| 95 | 1KΩ | |
| 97 | 0.01 μF | |
| 99 | | adjustable |
| 22 | | for 6.2 volts |
| V(max) | 48 | volts |
| 4/(reg) | 44 | volts |
| I(SC) | 0.5 | amps. |
| I(max) | 28. | amps. |
| V(1st) | ≈37.0 | volts |
| V(2nd) | ≈35.0 | volts |

Many changes and modifications in the above described embodiments of the invention can, of course, be carried out without departing from the scope thereof. Accordingly, the invention is disclosed and is intended to be limited only by the scope of the appended claims.

I claim:

1. A current limiting voltage regulator for a DC power supply that provides an output DC voltage comprising:

a current sensor means for sensing the current provided by the DC power supply to obtain a sensed current signal;

a threshold generator means for generating a dynamic current threshold reference signal;

a detector means for detecting when the sensed current signals exceed the dynamic current threshold reference signal and if detected to provide a voltage override signal according to a preselected function;

voltage control means for controlling the output DC voltage and in response to the voltage override signal adjusts the output DC voltage to limit the current flow from the DC power supply; and the first threshold generator means includes; a first threshold generator means for generating a first preselected threshold that is a first stage of the dynamic current threshold reference signal and when exceeded by the sensed current signal will cause the detector means to provide the voltage override signal of a first magnitude that will cause the voltage control circuit to reduce the DC output voltage to a first preselected output voltage, and a second threshold generator means for generating a second preselected threshold that is a second stage of the dynamic threshold reference signal and when exceeded by the sensed current signal at the first preselected output voltage will cause the detector means to provide the voltage override signal of a second magnitude that will cause the voltage control circuit to reduce the DC output voltage to a second preselected output voltage, and a third threshold generator means for generating a third preselected threshold that is a third stage of the dynamic threshold reference signal and when exceeded by the sensed current signal at the second preselected voltage will cause the detector means to provide the voltage override signal of a third magnitude that will cause the voltage control circuit to reduce the DC output voltage to a third preselected voltage.

2. The current limiting voltage regulator according to claim 1, wherein the current sensor means comprises:

a series resistor connected in the series with a first output terminal of the DC power supply.

3. The current limiting voltage regulator according to claim 1 or 2, wherein the first threshold generator means comprises:

a variable resistor means connected between a second output terminal of the DC power supply and a reference potential and having a wiper arm for providing a variable percentage of the voltage that is dropped across the variable resistor; and a firt zener diode connected in parallel with variable resistor means for regulating the potential across the variable resistor.

4. The current limiting voltage regulator according to claim 3, wherein the second and third threshold generator comprises:

a first input resistor means connected to the input of the detector means;

a zener diode connected between the wiper arm and the input resistor; and a second input resistor connected between the input of the detector means and the first output terminal of the DC power supply.

5. The current limiting regulator according to claim 1, wherein the detector means comprises:

difference amplifier means for obtaining difference between sensed current signal and the dynamic current threshold reference signal; and blocking diode means connected to the difference amplifier means output terminal for providing the voltage current signal only when the sensed current signal is greater than the current threshold reference signal.

6. The current limiting voltage regulator according to claim 1, wherein the voltage control means comprises:

an output reference signal source means for providing a first reference source;

comparator means for comparing the first reference source with the DC output voltage to obtain a control signal;

pass element means for providing a series resistance with the DC voltage, the magnitude of the series resistance being inversely proportional to the magnitude of the control signal; and override means for overriding the control signal with the voltage override signal and to quickly increasing thereby the magnitude of the series resistance of pass element means and thereby maximizing the Safe Operating Area (SOA) of the pass element.

7. A method for current limiting for a voltage regulated DC power supply that provides an output DC voltage comprising the steps of:

sensing the current provided by the DC power supply to obtain a sensed current signal;

generating a dynamic current threshold reference signal;

detecting when the sensed current signal exceeds the dynamic current threshold reference signal and to provide a voltage override signal according to a preselected function;

controlling the output DC voltage and in response to the voltage override signal adjusts the output DC voltage to limit the current from the DC power supply; and the steps of generating the dynamic current threshold reference signal includes the steps of; generating a first preselected threshold that is a first stage of the dynamic current threshold reference signal and when exceeded by the sensed current will generate the voltage override signal of a first magnitude that will reduce the DC output voltage to a first preselected output voltage, generating a second preselected that is a second stage of the dynamic threshold reference signal and when exceeded by the sensed current signal at the first preselected output voltage will generate the voltage override signal of a second magnitude that will reduce the DC output voltage to a second preselected output voltage, and generating a third preselected threshold that is a third stage of a dynamic threshold reference signal and when exceeded by the sensed current signal at the second preselected voltage will generate the voltage override signal of a third magnitude that will reduce the DC output voltage to a third preselected voltage.

* * * * *

UNITED STATES PATENT AND TRADEMARK OFFICE

CERTIFICATE OF CORRECTION

PATENT NO. : 4,346,342
DATED : August 24, 1982
INVENTOR(S) : James A. Carollo

It is certified that error appears in the above-identified patent and that said Letters Patent are hereby corrected as shown below:

Column 5, line 47, delete "go" and substitute therefor --do--;

Signed and Sealed this

*Fourteenth* Day of *December 1982*

[SEAL]

*Attest:*

GERALD J. MOSSINGHOFF

*Attesting Officer*

*Commissioner of Patents and Trademarks*